US009282791B1

(12) United States Patent
Doherty

(10) Patent No.: US 9,282,791 B1
(45) Date of Patent: Mar. 15, 2016

(54) BRACELET HAVING INTERNAL COMPARTMENT

(71) Applicant: Meghan M. Doherty, Needham, MA (US)

(72) Inventor: Meghan M. Doherty, Needham, MA (US)

( * ) Notice: Subject to any disclaimer, the term of this patent is extended or adjusted under 35 U.S.C. 154(b) by 0 days.

(21) Appl. No.: 14/211,386

(22) Filed: Mar. 14, 2014

Related U.S. Application Data

(60) Provisional application No. 61/790,233, filed on Mar. 15, 2013.

(51) Int. Cl.
*A44C 5/00* (2006.01)

(52) U.S. Cl.
CPC ..... *A44C 5/003* (2013.01)

(58) Field of Classification Search
CPC .... A44C 5/003; A44C 9/0061; A44C 9/0069; A44C 15/003; A44D 2203/00; B65D 85/02; B65D 85/04; B65D 85/671; B65D 85/672
USPC ..... 63/1.14, 15.1–15.4, 15.8, 900, 3; 206/303, 304, 304.1, 304.2, 37, 823, 206/389, 403, 409; 220/4.24, 4.26, 230; 225/44, 45, 39, 42, 46, 47, 51–53; 242/129, 405; 224/219, 222, 162; 24/303
See application file for complete search history.

(56) References Cited

U.S. PATENT DOCUMENTS

| | | | | |
|---|---|---|---|---|
| 4,842,212 | A * | 6/1989 | Loiselle et al. | 242/405 |
| 5,062,580 | A * | 11/1991 | Meagher | 242/125.2 |
| 6,145,722 | A * | 11/2000 | Behrens et al. | 225/42 |
| 2009/0293238 | A1 * | 12/2009 | Davis | 24/303 |

FOREIGN PATENT DOCUMENTS

DE 29511001 U1 * 10/1995

* cited by examiner

*Primary Examiner* — Abigail Morrell
(74) *Attorney, Agent, or Firm* — Burns & Levinson LLP; Bruce D. Jobse

(57) ABSTRACT

A bracelet has a pair of substantially annulus shaped members concentrically arranged about a common axis and shaped to define an intermediate cavity therebetween, which is selectively accessible in accordance with the relative positions of the members along the common axis. The intermediate cavity can be used to store personal effects.

16 Claims, 5 Drawing Sheets

Figure 2A
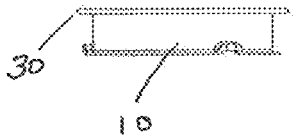
Figure 2B
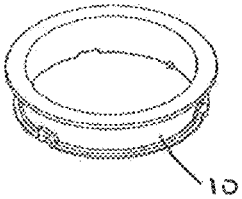
Figure 2C
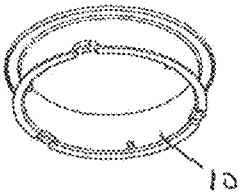
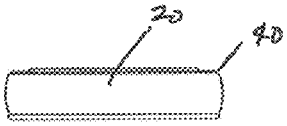
Figure 3A
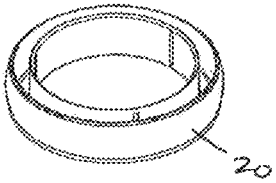
Figure 3B
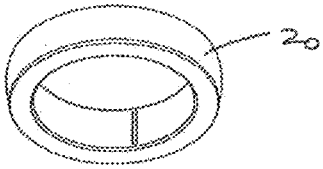
Figure 3C

BRACELET HAVING INTERNAL COMPARTMENT

CROSS-REFERENCE TO RELATED APPLICATIONS

This application claims priority to U.S. Provisional Application No. 61/790,233, filed on Mar. 15, 2013, which is incorporated by reference herein in its entirety and for all purposes.

FIELD OF THE DISCLOSURE

The present disclosure relates to apparel, and, more specifically, to a bracelet that may be used to store items.

BACKGROUND OF THE INVENTION

Jewelry is generally worn for its aesthetic value. Other items, such as wallets, purses, evening bags, fannie packs, etc., are worn or carried as a mechanism in which to the carry personal effects. Unfortunately, these items are typically larger and more cumbersome than jewelry or other items worn for adornment. Accordingly, need exists for an item whose function can be for both adornment and aesthetic value as well as to provide personal storage space.

SUMMARY OF THE INVENTION

Disclosed herein are embodiments of items of personal adornment that are not only aesthetically pleasing, but also provide a function to the wearer in the form of easily accessible space for storage of personal effects. More specifically, disclosed is a bracelet worn about the wrist that has an internal compartment or cavity that may be used to store personal items such as hair elastic. The bracelet has a pair of substantially annulus shaped members concentrically arranged about a common axis and shaped to define an intermediate cavity therebetween. The intermediate cavity is selectively accessible in accordance with the relative positions of the members along the common axis and may be used to store personal effects.

In accordance with one aspect of the disclosure a bracelet comprises: a pair of substantially annulus shaped members concentrically arranged about a common axis and shaped to define an intermediate cavity therebetween, wherein the intermediate cavity is selectively accessible to the exterior of the bracelet in accordance with the relative positions of the members along the common axis. The intermediate cavity is not accessible when the pair of members are disposed substantially adjacent to each other along the common axis but is accessible when the pair of members are disposed substantially apart from each other along the common axis.

In embodiments, the pair of members are slidably coupled together and may define complementary mating surface features to enable closure or separation of the members. In other embodiments, one of the pair of members comprises a plurality of guide slots and the other of the members comprises a plurality of guide posts, each guide post disposed in one of the plurality of guide slots. In still other embodiments, one of the pair of members comprises a first plurality of magnets each having a polarity and the other of the pair of members comprises a second plurality of magnets, each of the second plurality of magnets having a polarity opposite a polarity of one of the first plurality of magnets.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by reference signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure.

In the drawing:

FIGS. 2A-C illustrate conceptually side plan, top perspective, and bottom perspective views, respectively, of the inner member of the bracelet of FIG. 1 in accordance the disclosure;

FIGS. 3A-C illustrate conceptually side plan, top perspective, and bottom perspective views, respectively, of the outer member of the bracelet of FIG. 1 in accordance the disclosure;

DETAILED DESCRIPTION

Figure 1:
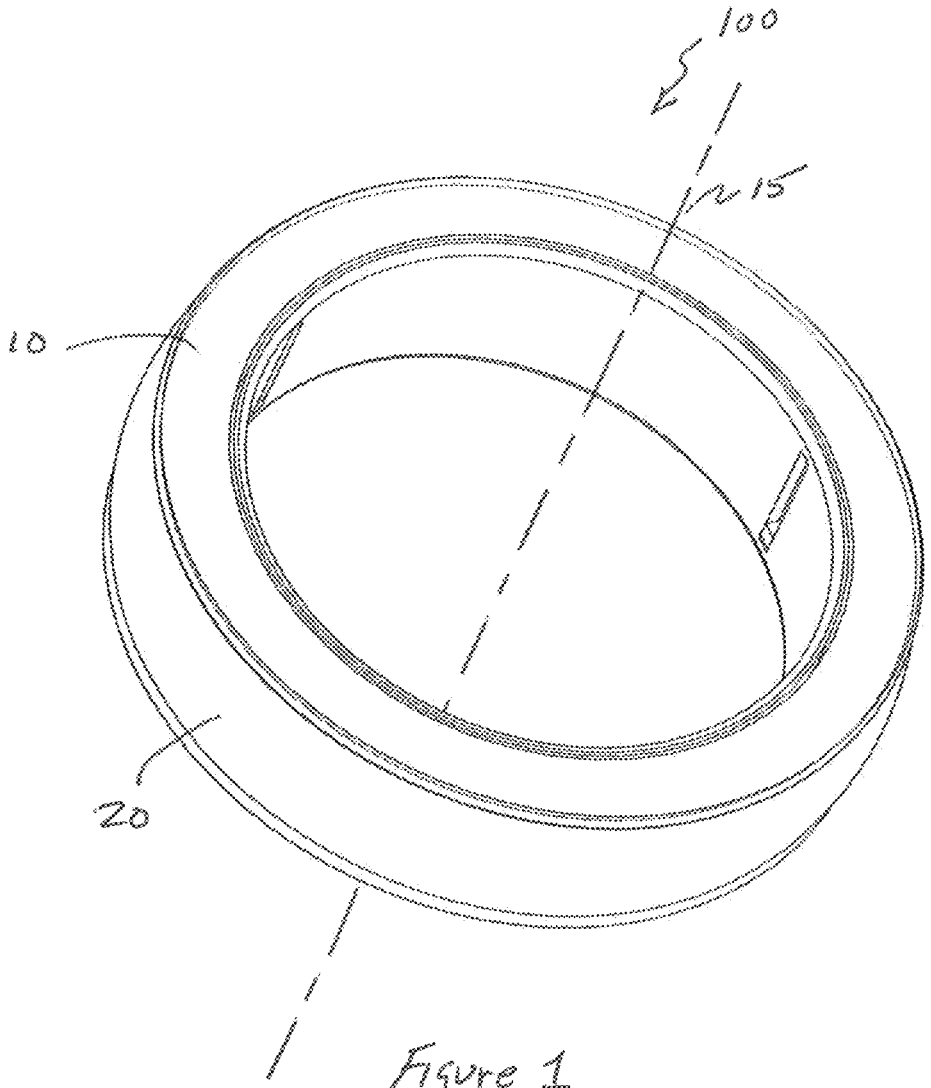
FIG. 1 illustrates conceptually a perspective view of a bracelet in a closed position in accordance the disclosure.

FIG. 1 illustrates conceptually a perspective view of a bracelet 100 in a closed position in accordance the disclosure. Bracelet 100 comprises a pair of substantially annulus shaped members, inner member 10 and outer member 20, concentrically arranged about a common axis 15 and slidably coupled together. As used herein, the term "annulus" is intended to mean any geometric shape defined by an exterior perimeter surface and an interior perimeter surface which defines an aperture or opening at the center of the geometric shape, such annulus not being just limited to circular in shape but having exterior and interior perimeter profiles which may be any of circular, oval, rectangular, hexagonal, polygonal or any other suitable geometry or, in any combinations, as illustrated in the Figures or their equivalents thereto. The interior and exterior perimeter profiles of members 10 and 20 do not have to be the same. For example, in one embodiment, both members 10 and 20 may have substantially circular interior perimeter's well their respective exterior perimeters may be of a different geometric shape than their respective interior perimeter surfaces.

Figure 5A:
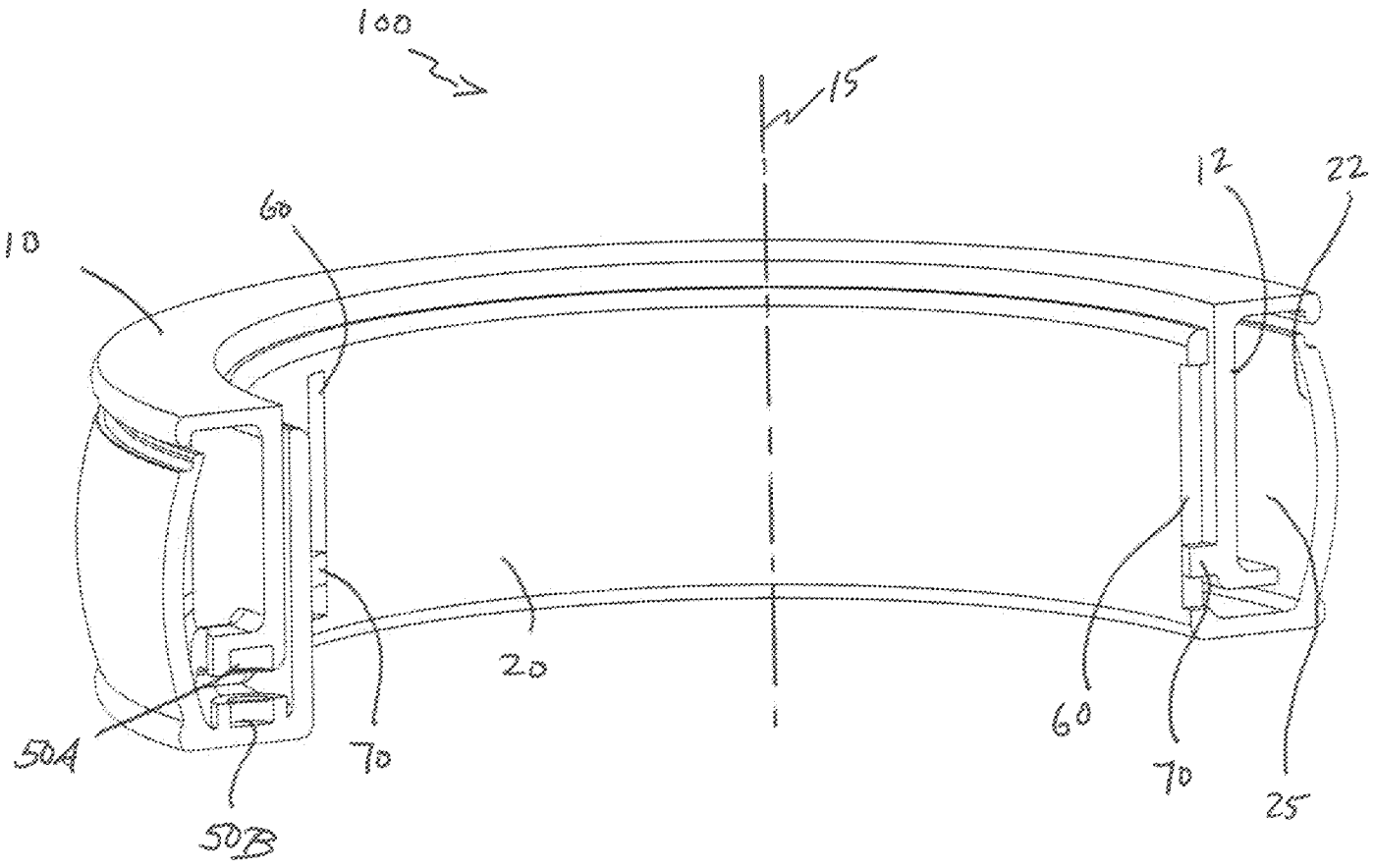
FIGS. 5A-B illustrate conceptually partially cutaway perspective views of the coupled inner and outer member of the bracelet of FIG. 1 in closed and open positions, respectively, in accordance the disclosure.
Figure 5B:
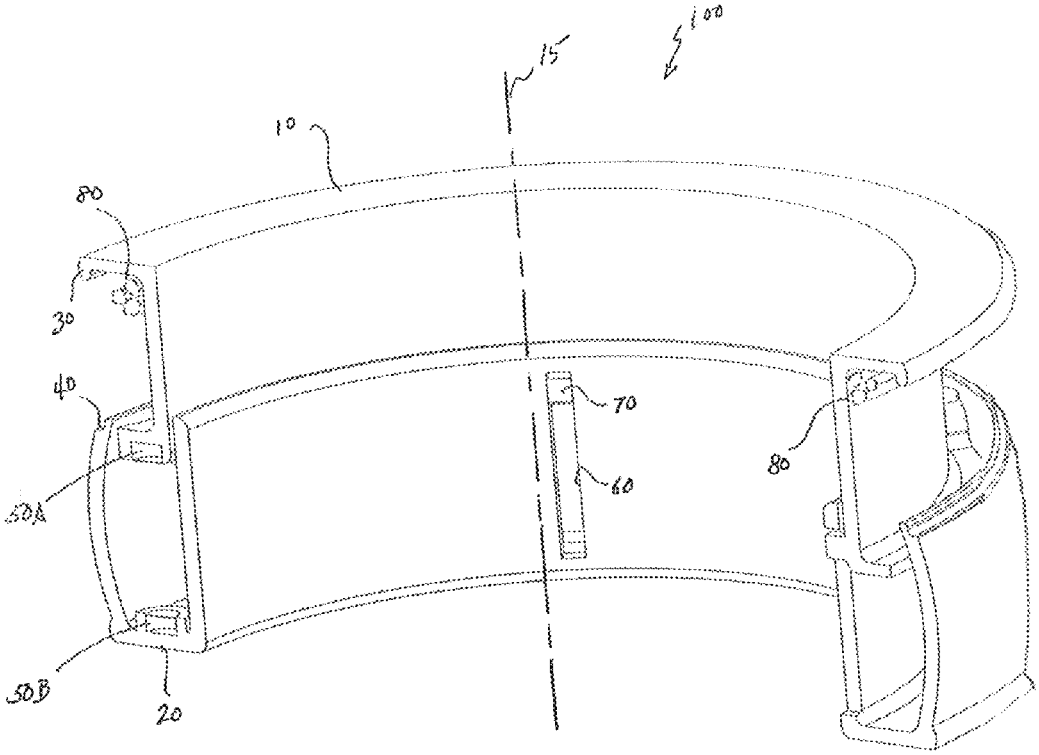

Referring to FIGS. 5A-B, each of members 10 and 20 are defined by an annulus wall. Inner member 10 defined by an annulus wall 12 having a substantially C-shaped cross-sectional profile which partially defines intermediate cavity 25, as illustrated. Outer member 20 is defined by an annulus wall 22 having a substantially U-shaped cross-sectional profile which also partially defines intermediate cavity 25, as illustrated. In the illustrative embodiment, the respective dimensions of inner member 10 relative to outer member 20 are chosen so that when inner member 10 is slidably disposed within outer member 20, their interior facing surfaces of walls 12 and 22, respectively, collectively define therebetween intermediate cavity 25 which also has a substantially annulus shape.

Intermediate cavity 25 is selectively and partially accessible in accordance with the relative positions of members 10 and 20 relative to each other along the common axis 15. As illustrated in FIG. 5A, intermediate cavity 25 is not accessible when members 10 and 20 are disposed substantially adjacent to each other along the common axis 15. Intermediate cavity 25 is at least partially accessible when members 10 and 20 are disposed substantially apart from each other along the common axis 15, as illustrated in FIG. 5B. The further apart members 10 and 20 are along common axis 15 the greater the amount of intermediate cavity 25 defined by member 10 is accessible exterior of or outside of bracelet 100.

FIGS. 2A-C illustrate conceptually side plan, top perspective, and bottom perspective views, respectively, of the inner member 10 while FIGS. 3A-C illustrate conceptually side plan, top perspective, and bottom perspective views, respectively, of the outer member 20. One or both of inner member 10 and outer member 20 of bracelet 100 may be formed from any material, including plastic, wood, natural or synthetic resins, or metals, such as brass, rhodium, silver, and gold, or may be formed from a plurality of materials including composite materials. The exterior surface of outer member 20 may be engraved, etched, adorned, or otherwise embellished for aesthetic value. Note that members 10 and 20 do not need to be made from the same materials.

In the embodiments illustrated in FIGS. 2A-5B, inner member 10 further comprises top lip 30 which protrudes outwardly from a circumferential edge of wall 12 of inner member 10. Outer member 20 further comprises an indentation 40 extends inwardly along a circumferential edge of wall 22 of outer member 20. When members 10 and 20 are in a closed or secure configuration, lip 30 mates or rests in indentation 40. As used herein, the term "mate" or "mating" may describe any manner of connecting or joining two or more components at least temporarily together.

Figure 4:
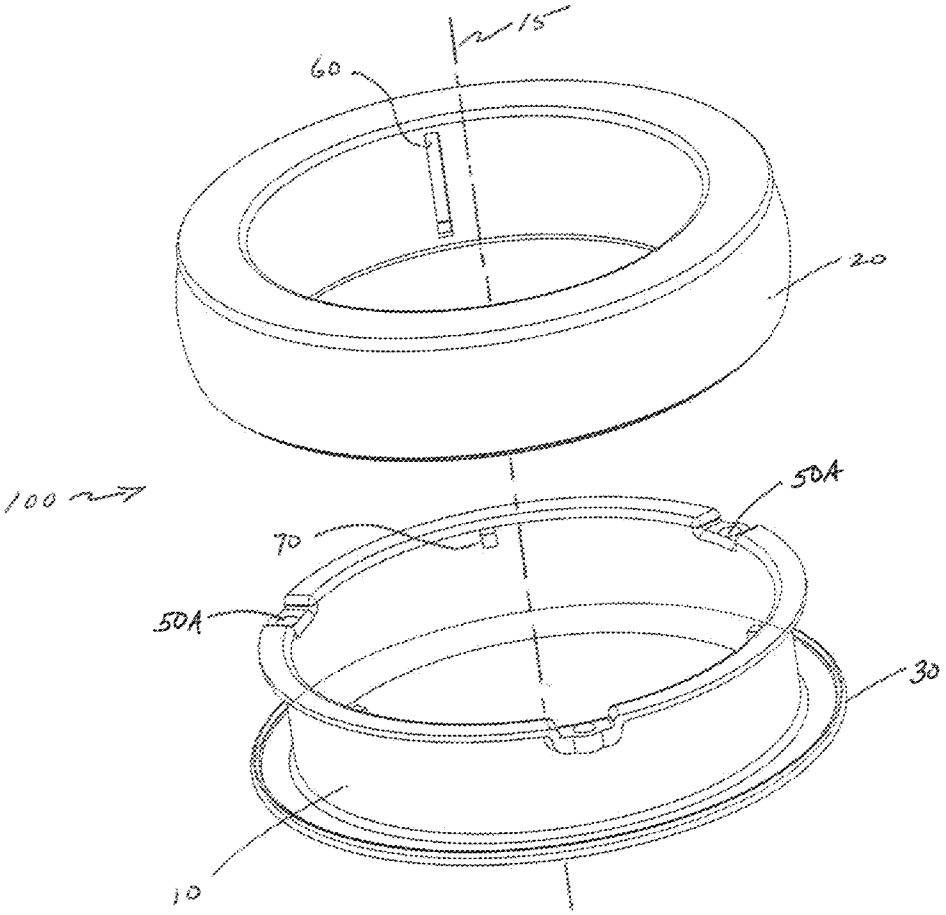
FIG. 4 illustrate conceptually an exploded perspective view of the uncoupled inner and outer member of the bracelet of FIG. 1 in accordance the disclosure.

In accordance with the embodiment illustrated in FIGS. 4-5B, bracelet 100 may further comprise a closing mechanism which may be used to retain members 10 and 20 in their closed or secured configuration with intermediate cavity 25 therefore inaccessible from outside of bracelet 100. In the illustrative embodiment, the closing mechanism may be implemented with one or more pairs of magnets of opposite polarity disposed on inner member 10 and outer member 20 such that they nest flush against one another when members 10 and 20 are in a closed configuration. In one embodiment, the first plurality of magnets 50A are fixed within inner member 10 and disposed substantially adjacent and opposite a second plurality of magnets 50B fixed within outer member 20, such that each magnet as a polarity which is opposite that of the magnet directly opposing it in the other member. In this manner, the bracelet 100 will remain in a close configuration until enough force is exerted to overcome the attraction between magnets 50A and 50B. It will be obvious to those reasonably skilled in the arts that other equivalent or different mechanical structures may be utilized to retain members 10 and 20 in a closed configuration without departing from the spirit or scope of the disclosure. Magnets 50A-B may be spaced along the perimeter shape of bracelet 100.

Bracelet 100 may comprise an alignment mechanism which prevents inner member 10 from separating completely from outer member 20 and further enables aligned movement of the members 10 and 20 relative to each other along common axis 15. Referring to FIGS. 4-5B, outer member 20 further comprises one or more grooves 60 extending through wall 22 on an interior perimeter surface thereof. Inner member 10 further comprises one or more corresponding protrusions 70 extending from wall 12 thereof. Protrusions 70 are sized and shaped to fit within grooves 60 as the members 10 and 12 are separated from each other along common axis 15. Groove 60 may traverse only a portion of the height of wall 22 of outer member 20. Protrusions 70 may extend outwardly from wall 12 a length great enough to protrude beyond the surface of wall 22 once disposed within grooves 60. The combination of groups and protrusion 70 may be spaced about the perimeter of bracelet 100.

Referring again to FIG. 5B, one or more hair elastics 80, illustrated in phantom, may fit within intermediate cavity 25 inner member 10 and outer member 20. Hair elastics 80 or other items may be stored in intermediate cavity 25 by sliding inner member 10 out from outer member 20. When inner member 10 is displaced along common axis 15 from outer member 20, bracelet 100 is in the open position. When bracelet 100 is in the open opposition, hair elastic 80 or other items may be fit around inner member 10. When bracelet 100 is closed, hair elastic 80 is fully concealed. Intermediate cavity 25 of bracelet 100 may, in addition or alternatively, be used to store trinkets and other items, and may, for example, store paper or other flexible materials. For example, an individual may have any number of objects including written reminders, emergency contact, an inspirational or spiritual quotation, etc a number type of objects being limited only by the dimensions of intermediate cavity 25.

Accordingly, the reader will appreciate that the bracelet disclosed herein provides conveniently accessible storage space which may be aesthetically pleasing and one for adornment as well as functionality.

Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least any of the embodiment. The appearances of such terms herein do not necessarily all refer to the same embodiment.

It is to be appreciated that embodiments of the bracelet discussed herein are not limited in application to the details of construction and the arrangement of components as set forth in the above description or illustrated in the accompanying drawings. The devices are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment.

Also, the phraseology and terminology used herein is for the purpose of description and should not be regarded as limiting. Any references to embodiments or elements or acts of the apparatus and methods herein referred to in the singular may also embrace embodiments including a plurality of these elements, and any references in plural to any embodiment or element or act herein may also embrace embodiments including only a single element. The use herein of "including," "comprising," "having," "containing," "involving," and variations thereof is meant to encompass the items listed thereafter and equivalents thereof as well as additional items. Any references to positional or spatial orientation are intended for convenience of description, not to limit the present apparatus and methods or their components.

Having described above several aspects of at least one embodiment, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only.

What is claimed is:

1. A bracelet comprising:

a pair of substantially annulus shaped members concentrically arranged about a common axis to define an intermediate cavity therebetween, each of the members having an open side oriented normal to the open side of the other member;

wherein the intermediate cavity is selectively accessible exterior of the bracelet in accordance with the relative positions of the members along the common axis;

wherein one of the pair of members comprises a plurality of guide slots oriented parallel with the common axis and the other of the members comprises a plurality of guide posts, each guide post disposed in one of the plurality of guide slots.

2. The bracelet of claim 1 wherein the pair of members are slidably coupled together.

3. The bracelet of claim 1 wherein the intermediate cavity is not accessible from exterior of the bracelet when the pair of members are disposed substantially adjacent to each other along the common axis;

wherein the guide posts are configured to slide within the respective guide slots along the common axis.

4. The bracelet of claim 1 wherein the intermediate cavity is accessible from exterior of the bracelet when the pair of members are disposed substantially apart from each other along the common axis.

5. The bracelet of claim 1 wherein the pair of members define complementary mating surface features to enable closure.

6. The bracelet of claim 5 wherein the plurality of guide slots and the plurality of guide posts prevent complete disengagement of the members from each other.

7. The bracelet of claim 5 wherein one of the pair of members comprises a first plurality of magnets each having a polarity and the other of the members comprises a second plurality of magnets, each of the second plurality of magnets having a polarity opposite the polarity of one of the first plurality of magnets.

8. The bracelet of claim 7 wherein each of the first plurality of magnets is fixed within one of the pair of members and is disposed substantially adjacent a magnet of the second plurality of magnets having an opposite polarity when the intermediate cavity is not accessible.

9. The bracelet of claim 1 wherein a first of the pair of members has a generally U-shaped wall defining an annular cavity.

10. The bracelet of claim 9 wherein a second of the pair of members has a generally C-shaped wall defining an annular cavity.

11. The bracelet of claim 10 wherein the C-shaped wall of the second member is at least partially slidably disposed in the annular cavity of the first member.

12. The bracelet of claim 10 wherein the second member has a lip projecting from a circumferential edge thereof.

13. The bracelet of claim 12 wherein the first member has an indentation defined along a circumferential edge thereof.

14. The bracelet of claim 13 wherein the intermediate cavity is not accessible exterior of the bracelet when the lip of the second member is disposed adjacent the indentation of the first member.

15. A bracelet comprising:

a first annulus shaped member having a substantially U-shaped cross-sectional profile defining a first open end;

a second annulus shaped member having a substantially C-shaped cross-sectional profile defining a second open end; and the first and second members concentrically arranged about a common axis so that the first and second open ends are oriented normal to each other to define an intermediate cavity therebetween;

wherein the intermediate cavity is selectively accessible exterior of the bracelet in accordance with the relative positions of the members along the common axis;

wherein one of the first and second members comprises a plurality of guide slots oriented parallel with the common axis and the other of the first and second members comprises a plurality of guide posts, each guide post disposed in one of the plurality of guide slots;

wherein the guide posts are configured to slide within the respective guide slots along the common axis.

16. A bracelet comprising;

a first annulus shaped member having a substantially U-shaped cross-sectional profile defining a first cavity with a first open end;

a second annulus shaped member having a substantially C-shaped cross-sectional profile defining a second cavity with a second open end, the second member slidably disposed within the first cavity; and the first and second members concentrically arranged about a common axis so that the first and second open ends are oriented normal to each other so that the first and second cavities together define an intermediate cavity;

wherein the intermediate cavity is selectively accessible exterior of the bracelet in accordance with the relative positions of the members along the common axis;

wherein one of the first and second members comprises a plurality of guide slots oriented parallel with the common axis and the other of the first and second members comprises a plurality of guide posts, each guide post disposed in one of the plurality of guide slots;

wherein the guide posts are configured to slide within the respective guide slots along the common axis.

* * * * *

UNITED STATES PATENT AND TRADEMARK OFFICE

CERTIFICATE OF CORRECTION

PATENT NO. : 9,282,791 B1
APPLICATION NO. : 14/211386
DATED : March 15, 2016
INVENTOR(S) : Meghan M. Doherty It is certified that error appears in the above-identified patent and that said Letters Patent is hereby corrected as shown below:

In the Claims

In column 6, line 33 (claim 16), "A bracelet comprising;" should read -- A bracelet comprising: --

Signed and Sealed this
Seventeenth Day of May, 2016

Michelle K. Lee

Michelle K. Lee
*Director of the United States Patent and Trademark Office*